United States Patent [19]

Stiltz et al.

[11] 4,265,435

[45] May 5, 1981

[54] HOME WORK BENCH

[75] Inventors: Erwin Stiltz, Winnenden-Schelmenholz; Heinz Lindenmayer, Hegnach; Wilhelm Geis, Leutenbach; Otto Wolf, Kirchheim-Teck, all of Fed. Rep. of Germany

[73] Assignee: Licentia Patent-Verwaltungs-G.m.b.H., Frankfurt am Main, Fed. Rep. of Germany

[21] Appl. No.: 965,888

[22] Filed: Dec. 4, 1978

[30] Foreign Application Priority Data

Dec. 2, 1977 [DE] Fed. Rep. of Germany ..... 2753685

[51] Int. Cl.[3] ..... B25B 1/22

[52] U.S. Cl. ..... 269/139; 269/220; 269/244; 269/901

[58] Field of Search ..... 269/139, 321 CF, 221, 269/222, 223, 244, 250–253

[56] References Cited

U.S. PATENT DOCUMENTS

| | | | |
|---|---|---|---|
| 985,857 | 3/1911 | Thomas | 269/222 |
| 1,125,207 | 1/1915 | Streeter et al. | 269/139 |
| 2,233,760 | 3/1941 | Wertz | 269/139 |
| 2,278,254 | 3/1942 | Enghauser | 269/222 |
| 3,060,917 | 10/1962 | Dickey | 269/244 X |
| 3,841,619 | 10/1974 | Hickman | 269/244 X |
| 4,061,323 | 12/1977 | Beekenkamp | 269/139 |
| 4,127,260 | 11/1978 | Hickmann | 269/321 CF |
| 4,154,435 | 5/1979 | Alessio | 269/139 |

*Primary Examiner*—Robert C. Watson

*Attorney, Agent, or Firm*—Spencer & Kaye

[57] ABSTRACT

A work bench includes a frame formed of interconnected longitudinal and transverse section beams defining a frame plane; and a vise formed of a stationary vise jaw and a movable vise jaw movable towards and away from the stationary vise jaw generally in a direction parallel to the transverse beams. The movable vise jaw is displaceably supported on the transverse beams by a spindle-and-guide arrangement. Each transverse beam has an open side oriented in a direction parallel to the frame plane and a leg part extending in the length dimension of the transverse beam and having wall faces arranged parallel to the frame plane. A guide member is affixed to the movable vise jaw adjacent each transverse beam. The guide member, which has a part traversed by the spindle, is provided with a groove-like recess extending in the length dimension of the respective transverse beam. The leg of the respective transverse beam extends into the groove-like recess in the respective transverse beam.

9 Claims, 10 Drawing Figures

HOME WORK BENCH

BACKGROUND OF THE INVENTION

This invention relates to a home work bench which has a horizontal frame formed of longitudinal and transverse beams and at least one vise arranged on the transverse beams and adjustable by threaded spindles and guide elements supported in the transverse beams.

In a known home work bench of the above-outlined type, the transverse beams have a U-shaped cross section which are arranged with their open side oriented downwardly and which have in their upper face a longitudinal slot for receiving and guiding an upper attachment of a nut body engaged on the threaded spindle. The nut body is connected by means of two cams and a screw with a guide element provided on the underside of the vise jaws.

It has been found that if the vise is, while empty, that is, without a workpiece to be clamped between the jaws, shifted by inexpert handling of the tool and contrary to operating instructions in such a manner that the movable jaw is, beyond its play, set obliquely to the other vise jaw (by applying forces or torques which significantly exceed the normal clamping forces), deformations of the transverse beams result. These manifest themselves as bulging portions of the slotted regions leading to enlargements of the slots themselves. Although these deformations are, as a rule, of elastic nature, that is, after the generated forces are removed, the transverse beams again resume their original shape and position and the slot distance too, assumes its original dimensions, such occurrences are undesirable, since the excessive forces may result in corresponding shearing forces on the cams of the guide elements or slide components.

SUMMARY OF THE INVENTION

It is an object of the invention to provide an improved home work bench of the above-outlined type in which, with economic means, a stability is achieved resulting in the elimination of the described phenomena even in case of applying maximum possible forces.

This object and others to become apparent as the specification progresses, are accomplished by the invention, according to which, briefly stated, the work bench includes a frame formed of interconnected longitudinal and transverse section beams defining a frame plane; and a vise formed of a stationary vise jaw and a movable vise jaw movable towards and away from the stationary vise jaw generally in a direction parallel to the transverse beams. The movable vise jaw is displaceably supported on the transverse beams by a spindle-and-guide arrangement. Each transverse beam has an open side oriented in a direction parallel to the frame plane and a leg part extending in the length dimension of the transverse beam and having wall faces arranged parallel to the frame plane. A guide member is affixed to the movable vise jaw adjacent each transverse beam. The guide member which has a part traversed by the spindle, is provided with a groove-like recess extending in the length dimension of the respective transverse beam. The leg of the respective transverse beam extends into the groove-like recess in the respective transverse beam.

DESCRIPTION OF THE PREFERRED EMBODIMENTS

Figure 1:
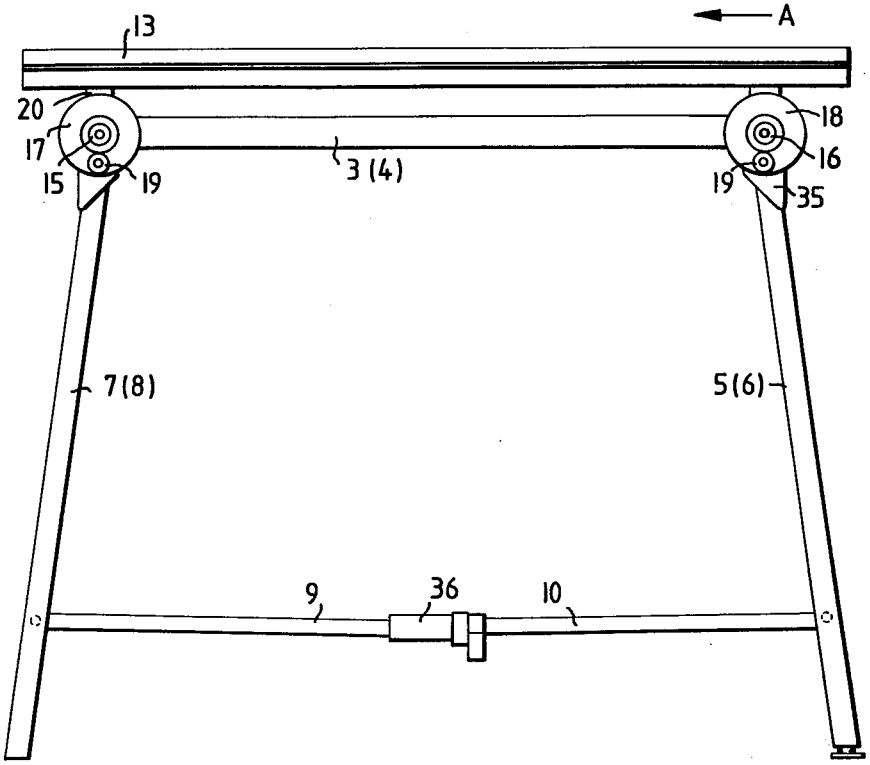
FIG. 1 is a schematic front elevational view of a preferred embodiment of the invention.
Figure 2:
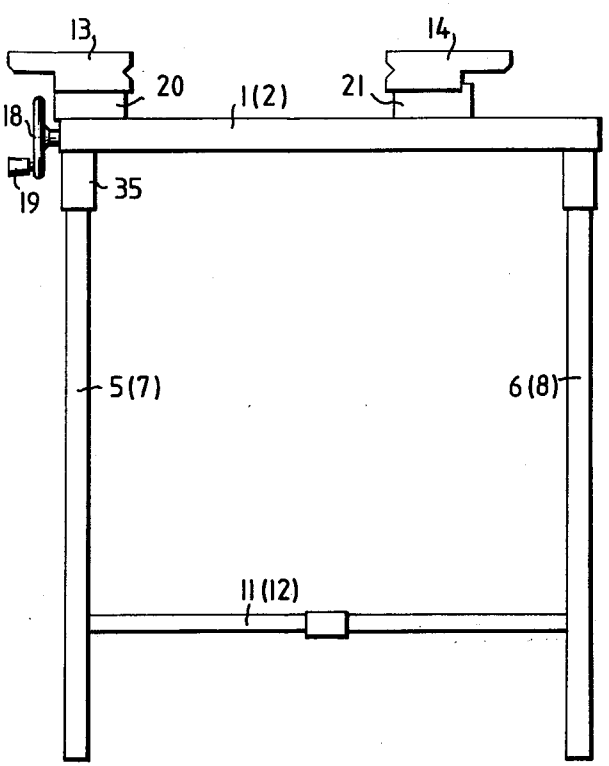
FIG. 2 is a schematic side elevational view of the same embodiment as seen in the direction of arrow A of FIG. 1.

Turning now to FIGS. 1 and 2, the home work bench shown therein has a frame stand which is formed of two parallel transverse beams 1, 2, two parallel longitudinal beams 3, 4, four legs 5, 6, 7, 8 and two longitudinal interconnected rod parts 9, 10 the ends of which are arranged pivotally in respective transverse braces 11, 12. It is noted that in the Figures the reference numerals of hidden components are placed in parantheses.

The beams 1–4 define a generally horizontal frame plane. The home work bench further comprises a stationary vise jaw 13 which is fixedly attached to the transverse beams and a movable vise jaw 14 which is displaceable by means of two rotatable threaded spindles 15, 16 provided for this purpose with hand wheels 17, 18, respectively, each having a handle 19. The stationary vise jaw 13 is attached to the frame formed of the beams 1–4 with the intermediary of a height-compensating spacer 20, while the movable vise jaw 14 is mounted on the frame by means of guide elements 21, one associated with each threaded spindle.

Each longitudinal beam 3, 4 is a tube of rectangular cross section, whereas the transverse beams 1, 2 have a U-shaped cross section. The longitudinal and transverse beams are welded to one another.

Figure 4:
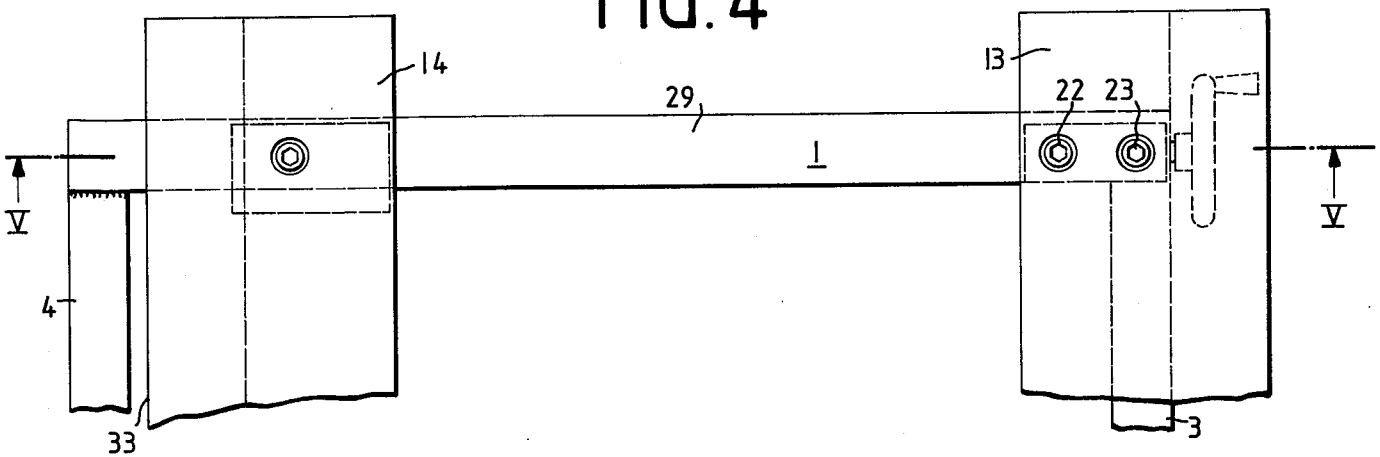
FIG. 4 is a fragmentary schematic top plan view of the same embodiment.
Figure 5:
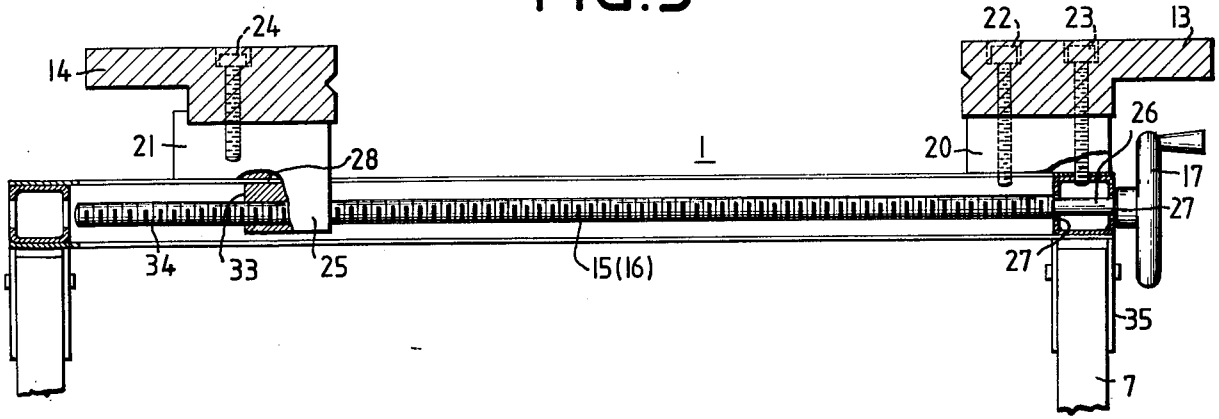
FIG. 5 is a sectional view taken along lines V—V of FIG. 4.

Turning now to FIGS. 4 and 5, the stationary vise jaw 13 is, at each spindle, connected by screws 22, 23 with the respective transverse beam 1, 2 with the intermediary of the spacers 20. The displaceable vise jaw 14 is, likewise at each spindle, secured by at least one screw 24 to the guide element 21 which has, at both ends, a threaded part 25 through which passes the respective threaded spindle 15, 16. Thus, upon rotation of the threaded spindles, the guide element 21 is moved, dependent upon the sense of rotation, with the displaceable vise jaw 14 in the forward or rearward direction.

The threaded spindles 15, 16 have at that end which is adjacent the respective hand wheel 17, 18, a cylindrical bearing pin 26 which is rotatably supported in bores 27 in the wall of the transverse beam 1, 2 and receives the associated hand wheel which is secured to the respective threaded spindle by means of a pin or similar mounting element.

Figures 3, 9:
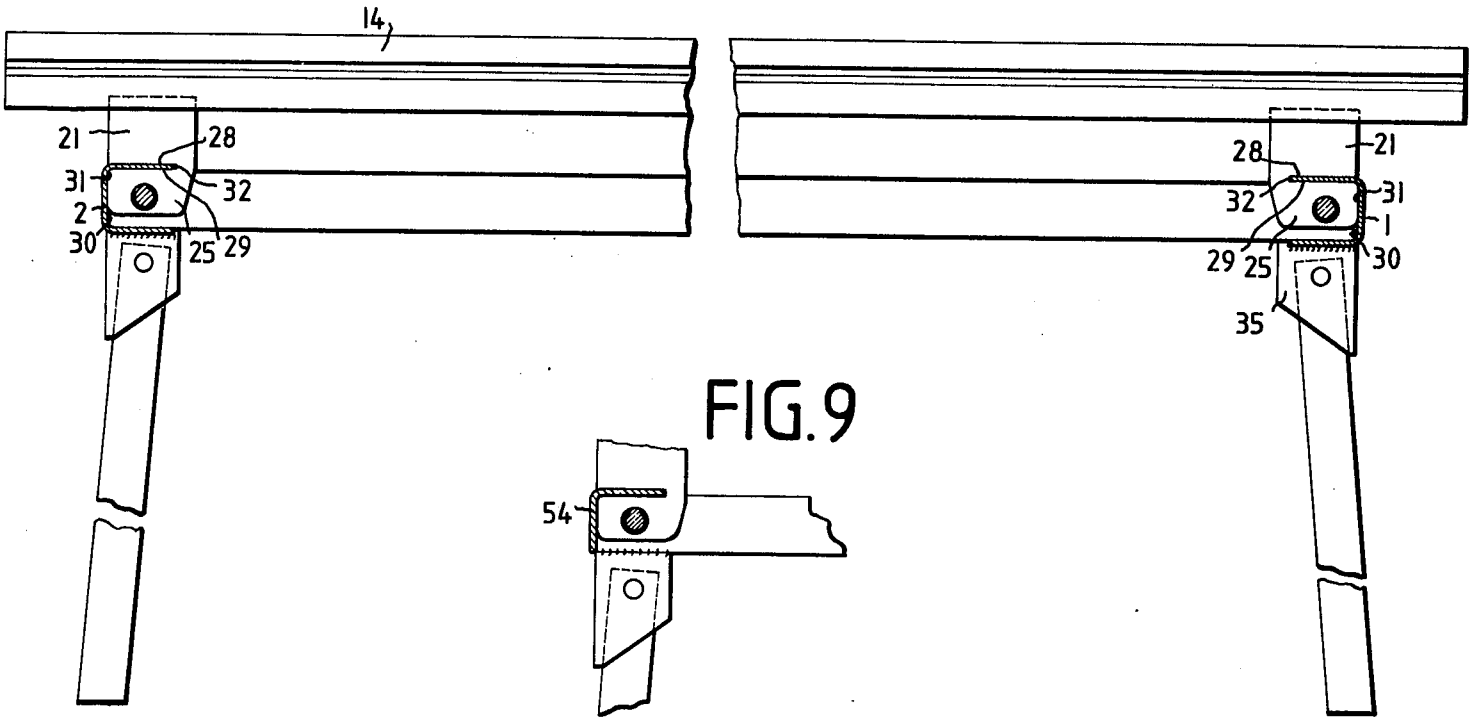
FIG. 3 is a schematic sectional front elevational view of the same embodiment.
FIG. 9 is a sectional front elevational view of a modified part of the structure shown in FIG. 3.

Also referring now to FIG. 3, the guide elements 21 have a groove-like recess 28 into which project the horizontally extending leg 29 of the respective transverse beam of U cross section. The recess 28 forms, together with the leg 29 of the respective transverse beam, the guide for the movable vise jaw 14 for limiting its lateral and vertical displacements. The recess 28 extends on one side 21*a* of the guide member 21 parallel to the length of the respective transverse beam 1, 2 and has a depth which extends from the side 21*a* to a point beyond a halving (central) plane a which passes through each transverse beam 1, 2 and which is parallel to the length of the transverse beams and perpendicular to the frame plane defined by the beams 1–4. Further, the leg 29 projects into the recess 28 from the side 21*a* of the respective guide member 21 to a point which is beyond central plane a. Each spindle 15, 16 is situated within the space inside the respective transverse beam such that the leg 29 fully overlaps the spindle when viewed from the direction of the movable vise jaw 14.

The inner face 30 of the vertically extending web of the transverse beams 1 and 2 may serve as guiding abutments for a shoulder 31 of the part 25 of the guide element 21 situated underneath the leg 29. Dependent upon the actual structure, the base 32 of the groove-like recess 28 in the guide elements 21 may serve as a guiding abutment in the horizontal plane for the free edge or the wall face of the leg 29. It is to be understood that the beams may have an L-shaped cross section 54 (FIG. 9) or other appropriate configuration, with their open side oriented in a direction parallel to the frame plane and with a leg which has wall faces extending parallel to the frame plane.

The movable vise jaw 14 is displaceable by rotating the threaded spindles 15, 16 with the respective hand wheels 17, 18 either simultaneously or individually. In case of individual or opposite actuation of the hand wheels or in case of unlike actuation periods of the two hand wheels in the same sense of rotation, the displaceable vise jaw 14 can be set at an inclined orientation relative to the stationary vise jaw 13 as permitted by the play between the cooperating components. Thus, to a certain limit, conical components too, may be clamped by the vise 13, 14. In this connection it has been found to be particularly advantageous to arrange in the spindle-receiving part 25 of the guide element 21 a nut 60 (FIG. 10) for threadedly engaging the associated spindle. The nut may be of steel or similar material. It has been found to be particularly advantageous to use a nut made of a plastic material, such as an acetal polymer (Delrin). It is further feasible to provide a centrally located manual actuator to operate the two threaded spindles in unison.

Reverting once again to FIGS. 4 and 5, the movement of the displaceable vise jaw 14 away from the direction of the stationary vise jaw 13 is limited by the end face 33 of the spindle-receiving part 25 of the guide element 21 as the end face 33 abuts the longitudinal beam 4, as shown in FIGS. 4 and 5. The rearward ends 34 of the threaded spindles 15 and 16 are free, that is, they are not supported by any guide. Such an arrangement is of advantage regarding the oblique setting of the movable vise jaw 14.

The underside of the beam assembly 1–4 is provided with sockets 35 in which there are swingably supported the yoke-shaped table legs. In the end of the longitudinal rod part 9 (FIG. 1) there is axially inserted an adjustable threaded pin, the end face of which abuts the end of the aligned longitudinal rod part 10 when the assembly 9, 10 is in the tensioned state. The location of connection between the two longitudinal rod parts 9, 10 is covered by a U-shaped flip element 36 which is pivotally supported on one of the rod parts 9 or 10.

Figures 6, 10:
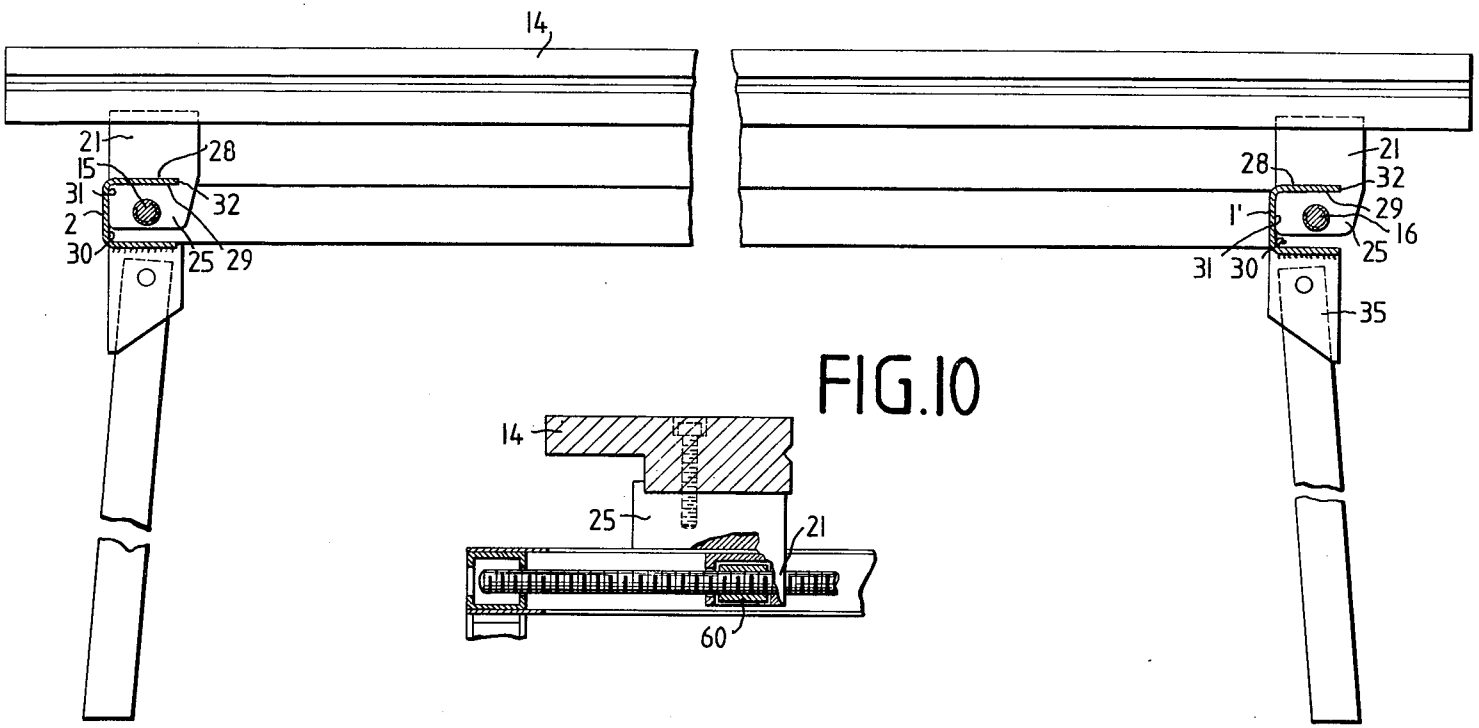
FIG. 6 is a sectional side elevational view of a modified embodiment.
FIG. 10 is a sectional side elevational view of a modified part of the structure shown in FIG. 5.

Turning now to FIG. 6, in the embodiment of the home work bench shown therein the open sides of the two transverse beams 1', 2 of U cross section are not oriented towards one another as was the case in the structure shown in FIG. 3, but the vertically extending web of the beam 1' is oriented towards the open side of the beam 2. This arrangement in which the transverse beams, regarding their cross section, are not in a mirror image but are identically oriented, has the particular advantage that the guide elements 21 may be mounted with or without spindles 15 and 16 in a simple, time-saving manner. Further, in this embodiment, the left-hand guide element 21 is identical in structure to the right-hand guide element (unlike in the FIG. 3 embodiment) so that only one type of guide element needs to be stored. It is to be understood that it is also feasible to arrange the two transverse beams in such a manner that their open sides are mutually oriented away from one another.

Figure 7:
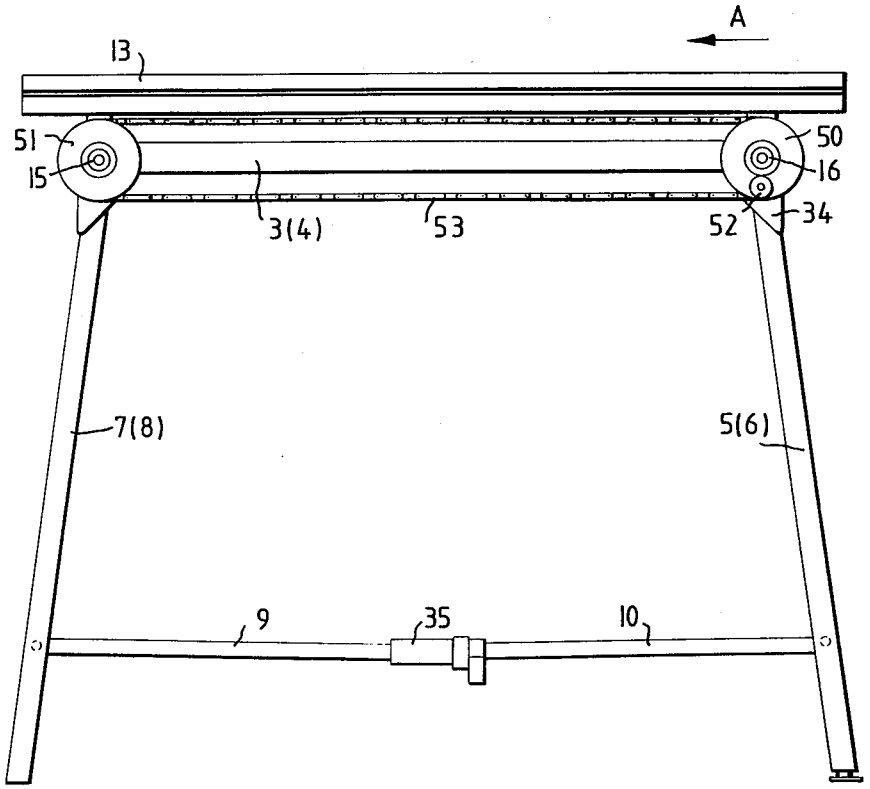
FIG. 7 is another preferred schematic front elevational view of a embodiment of the invention.
Figure 8:
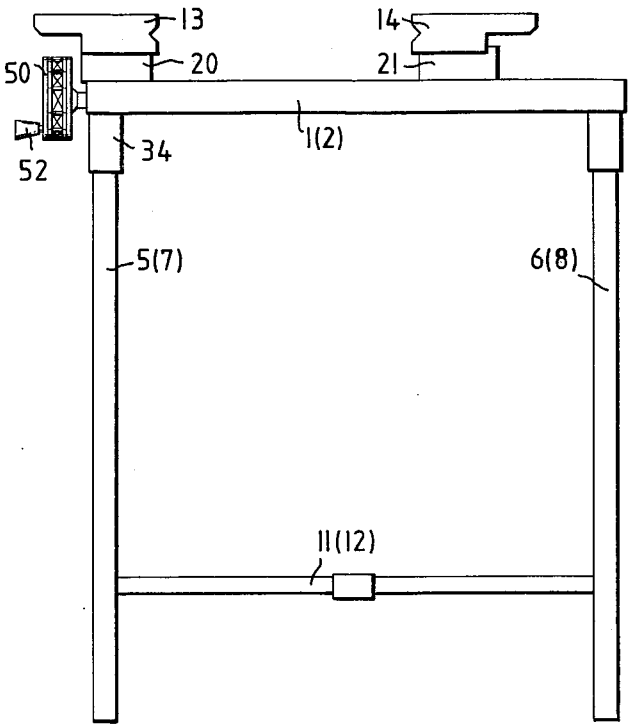
FIG. 8 is a schematic side elevational view of the embodiment according to FIG. 7.

As shown in FIGS. 7 and 8, the mechanism for moving the two spindles 15,16 is an optional link between them such as a chain 53 trained about chain pulleys 50,51. The chain pulley 50 has a handle 52.

It is to be understood that the above description of the present invention is susceptible to various modifications, changes and adaptations, and the same are intended to be comprehended within the meaning and range of equivalents of the appended claims.

What is claimed is:

1. In a work bench including a frame formed of interconnected longitudinal and transverse section beams defining a frame plane; a vise including at least one movable vise jaw being arranged on the transverse beams and being displaceable in a direction generally parallel to the length of the transverse beams; threaded spindles supported in the frame; guide members affixed to said movable vise jaw and threadedly mounted on respective said threaded spindles for displacing said movable vise jaw; each guide member having a central plane being parallel to the length of the transverse beams and being perpendicular to the frame plane; the improvement wherein each transverse beam has first and second leg parts extending parallel to the length of the respective transverse beam and joining one another; further wherein said first leg part has inner and outer wall faces situated parallel to said frame plane; said outer wall face of said first leg part being oriented towards said movable vise jaw; further comprising means defining a groove-like recess in each guide member; said recess having a length extending parallel to the length of the transverse beams and a depth extending perpendicular to the length dimension of the transverse beams and parallel to said frame plane; the depth dimension extending from one side of the respective guide member to a point beyond said central plane thereof; said first leg part of each said transverse beam being longitudinally slidably received in said recess; the respective said first leg part of said transverse beam projecting into said recess from said one side of the respective said guide member to a point beyond said central plane thereof; each said threaded spindle being situated within a space defined by said first and second leg parts of the respective said transverse beam; said first leg part of each transverse beam fully overlapping the respective said threaded spindle as viewed from the direction of said movable vise jaw.

2. A work bench as defined in claim 1, further comprising nut members supported in said guide members for threadedly engaging the spindles.

3. A work bench as defined in claim 1, wherein said transverse beams have an L cross section.

4. A work bench as defined in claim 1, wherein said second leg part of each said transverse beam has opposite wall faces oriented perpendicularly to said frame plane; each said guide member having a part cooperating with one of said wall faces of said second leg part for guiding the resepective guide member during displacement of said movable jaw.

5. A work bench as defined in claim 1, wherein said first leg part of each said transverse beam has an outer edge and wherein each groove-like recess has a bottom; said bottom cooperating with said outer edge for limiting a lateral displacement of the respective guide member during motion of said movable vise jaw.

6. A work bench as defined in claim 1, wherein said transverse beams are, in regard to their cross-sectional shape, arranged in a mirror image with respect to one another.

7. A work bench as defined in claim 1, wherein said transverse beams are, in regard to their cross-sectional shape, oriented in the same direction.

8. A work bench as defined in claim 1, wherein each said transverse beam has a third leg part extending parallel to said first leg part and joining said second leg part whereby each transverse beam has a cross-sectionally U-shaped configuration having an open side; said open side of each said transverse beam being oriented towards said guide members associated with a respective said transverse beam.

9. A work bench as defined in claim 1, further comprising means for setting said guide members independently from one another within limits of the play between cooperating components for setting said movable vise jaw at an oblique inclination with respect to a direction parallel to the length of the longitudinal beams.

* * * * *